United States Patent [19]

Chiostri et al.

[11] 4,453,856

[45] Jun. 12, 1984

[54] SELF-PROPELLED OPERATING APPARATUS FOR THE REGENERATION PAVEMENT

[75] Inventors: Mario Chiostri, Sesto Fiorentino; Pierluigi Ceseri, Florence, both of Italy

[73] Assignee: Autostrade-Concessioni e Costruzioni Autostrade S.p.A., Italy

[21] Appl. No.: 271,018

[22] Filed: Jun. 5, 1981

[51] Int. Cl.[3] ..... E01C 23/06

[52] U.S. Cl. ..... 404/91; 404/95; 404/92; 404/108; 404/111

[58] Field of Search ..... 464/91, 90, 77, 79, 464/75, 95

[56] References Cited

U.S. PATENT DOCUMENTS

| | | | |
|---|---|---|---|
| Re. 22,502 | 6/1944 | Wood | 404/91 |
| 2,394,017 | 2/1946 | Seaman | 404/91 |
| 2,747,475 | 5/1956 | West | 404/91 |
| 3,055,280 | 9/1962 | Neville | 404/95 |
| 3,843,274 | 10/1974 | Gutman | 404/91 |
| 4,011,023 | 3/1977 | Cutler | 404/91 |
| 4,124,325 | 11/1978 | Cutler | 404/95 X |
| 4,172,679 | 10/1979 | Wirtgen | 404/95 X |
| 4,252,459 | 2/1981 | Jeppson | 404/95 X |
| 4,252,487 | 2/1981 | Jeppson | 404/95 X |
| 4,272,212 | 6/1981 | Bauer | 404/91 X |
| 4,276,093 | 6/1981 | Pickermann | 404/95 X |
| 4,317,642 | 3/1982 | Wirtgen | 404/91 X |
| 4,335,975 | 6/1982 | Schoezkopf | 404/95 X |

*Primary Examiner*—Nile C. Byers, Jr.

*Attorney, Agent, or Firm*—McGlew and Tuttle

[57] ABSTRACT

A self-propelled pavement lane apparatus comprising a radial-frequency microwave generator extending across one lane of the roadway having an antenna with a slotted waveguide directed toward the roadway for heating a lane-wide stretch of the roadway. A ripping device is provided behind the microwave generator to rip up pavement which was heated by the microwave generator. A screw conveyor conveys the heated and ripped pavement inwardly toward a central axis of the apparatus where it is fed by a chute to a mixing chamber containing counter-rotating mixing blades. Fresh bituminous binder and/or filler may be added to the mixing chamber to be mixed with the ripped pavement which is then discharged from the mixing chamber by a second screw conveyor, to be distributed across the lane. Following the second screw conveyor is a finished plate for initially compacting the refinished surface. The apparatus includes a tank for containing hydraulic fluid for operating a generating unit to power the microwave generator as well as tanks for the filler and binder.

5 Claims, 6 Drawing Figures

SELF-PROPELLED OPERATING APPARATUS FOR THE REGENERATION PAVEMENT

FIELD AND BACKGROUND OF THE INVENTION

The invention concerns a self-propelled operating apparatus for the regeneration, in place, of road pavement made of a bituminous mix, utilizing pavement heating, a radio-frequency microwave generator couple with at least an illuminator device of the slotted waveguide type, which is able to radiate and distribute toward the ground, the produced energy.

Through one passage only of the apparatus it is feasible to heat the road paving or carpet along the whole width of a lane up to 4 to 4.5 m, to scarify the layer for the whole desired thickness, to regenerate the removed material with optional additions of bitumen and/or filler, to lay off on the ground and to effect a first compaction of the regenerated material, so eliminating the need of transporting materials to the discharge point and of conveying the new mix.

The feeding velocity of the apparatus during the operational phase is foreseen to be up to 4 m per minute.

According to the invention, all the elements and members composing the apparatus are dimensioned in such a way that the whole work will be effected without any discontinuity. In other words, the amount of bituminous mix heated, ripped, collected, raised and entering a homogenizing-mixing device in a certain interval of time, determined as a function of the feeding speed, is such that in the same interval of time the same amount of bituminous mix, with optional additions of bitumen and/or filler will be treated by said homogenizing-mixing device and then discharged, distributed and compacted, so achieving the whole and total regeneration of the road carpet.

By means of the employment of heating sets according to the invention it is feasible to control the depth of the heated layer, so that, without modifying the temperature and the feeding speed of the apparatus, such thickness will be larger than the thickness of the layer that one wants actually to scarify, in order to subject it to the mixing and homogenizing treatment.

The heating of the deeper layer appears to be advantageous, since it allows the elimination of possible crackings present in the layer. This result cannot be achieved through the employment of conventional heat sources, whose action is limited to a thickness of a few centimeters, generally 3 to 5 cm.

According to a further feature of the invention, it is foreseen that a scraping blade and a chute can be lifted, so that the material, heated, scarified by means of rippers and removed by collecting and distributing screw feeders, may be directly compacted by a finishing machine, thus avoiding the passage through the device of the homogenizing and mixing treatment, with or without the addition of filler and/or binder, whenever it is deemed to be unnecessary.

The bitumen, out of the contact with the air and protected from the light, keeps, practically for an unlimited period of time, its own physical-chemical and rheological characteristics.

The bituminous mix for road superstructures, substantially composed of a hot mixture of aggregate lithoid materials and bitumen, follows completely the abovementioned law, keeping substantially unchanged the rheological characteristics which it has acquired at the moment of its preparation and laying off.

The end of the useful life of the road pavings of this type takes place usually owing to the fatigue failure of the layers which are bound with the bitumen. Breaks are formed which cross the layers, so that water and dust can penetrate into said breaks thus creating diaphragms which make the deterioration process an irreversible one.

The widening and extending of the breaks involve ratchiness formation, holes and break-through actions until the demolition and the remaking of the paving layers cannot be delayed any more.

the residues of the demolition of a paving, if they are heated with proper care upto the temperature of the original paving preparation (150°–180° C.) and mixed again, give rise to bituminous mixes whose features are completely similar to the original ones, and give rise to pavings, whose behaviour and strength are almost equal to those of the first installation.

To date, the regeneration of said materials in placehas never been advantageously achieved on an operational scale owing to the difficulty of providing heating systems suitable to prevent the alteration and deterioration of the characteristics of the bituminous binder.

It is known, indeed, that the bitumen loses completely or partially its binding qualities if it is heated to temperatures exceeding 200° C. approximately. Even a heating effected within said temperature limits, if it takes place in the presence of air, implies oxidation phenomena which alter its essential properties.

With systems now known, since the bitumen and the aggregate mateials are bad conductors, in order to correctly heat the heap of fragments, a prolonged exposition is needed to low-temperature heat-sources, in a conventional way, which makes any apparatus for the regeneration of the materials in place and their reuse for the remaking of the damaged paving disadvantageous .

The above explains the reason why until today, in the case of maintenance interventions upon a roadway, particularly in the cases which do not concern only the "cortical" portion, that is the worn layer only, the method is still accepted of the demolition of the bituminous paving, for instance by means of a tearing action, followed by the removal and the transport of the demolished material to a dumping place, and the re-building of the paving with a new bituminous mix, with all the related inconveniences.

SUMMARY OF THE INVENTION

The present invention concerns a self-propelled operating apparatus for the regeneration of pavement, in place, said apparatus utilizing for the heating of the paving itself a radio-frequency micro-wave generator coupled with at least an illuminator device of the slotted wave-guide type, able to radiate the produced energy and to distribute it towards the ground.

This operating apparatus is substantially composed of a self-propelled frame, preferably track-mounted, provided with an engine and steering means, on which there is provided:

a generating unit, capable to feed at least a radio-frequency microwave generator coupled with at least one illuminator device of the slotted wave-guide type, able to radiate and distribute towards ground, the produced energy;

devices to demolish the portion of paving,. previously heated, that one wants to regenerate;

devices for the removal and the raising of the demolished materials from the ground;

at least one homogenizing and mixing device, preferably of the counter-rotating blade type, for said mateials;

a bituminous binder tank provided with a spray nozzle to feed optional correcting additions of bitumen into the homogenizing and mixing device;

a filler tank provided with a batching device to feed optional correcting additions of filler into the homogenizing and mixing device;

a distributing device for the materials exiting from the homogenizing and mixing device; and a finishing plate for the laying off and the first compaction of the regenerated mix.

The advantages which can be achieved through the employment of the apparatus according to the invention are the following:

a simultaneous and uniform heating at a perfectly controllable temperature, for the whole mass which is subjected to the treatment, overcoming the obstacle of poor thermal conductivity which is characteristic for the material which is considered, through the utilization of the energy emitted by the illuminator device coupled with the radio-frequency microwave generator;

the regulation of the depth of the road paving layer which one wants to regenerate;

a reduced size of the heating device in comparison with known devices and, therefore, a better maneuverability of the whole operating apparatus in comparison with known apparatuses; and a regeneration in place of the paving which is the object of the maintenance intervention, with the elimination of the costs for tearing, the loading and the transport of the demolished material to the discharge point and for the delivery and laying off of the new mix which would be necessary for the rebuilding of the carpet.

Furthermore, the length of the road yard appears to be extremely contained and there are no interruptions between the operational phases, so that at the end of the day's work it is possible to open again to the traffic, whole lane, considering also that it is easy to park the whole apparatus in the laybies, given its minimal size.

Other characteristics and advantages of the invention will appear from the following description and from the attached drawings in which a non-limiting but non-limitative way, a preferred embodiment of the invention is represented.

DESCRIPTION OF THE PREFERRED EMBODIMENT

Figure 1:
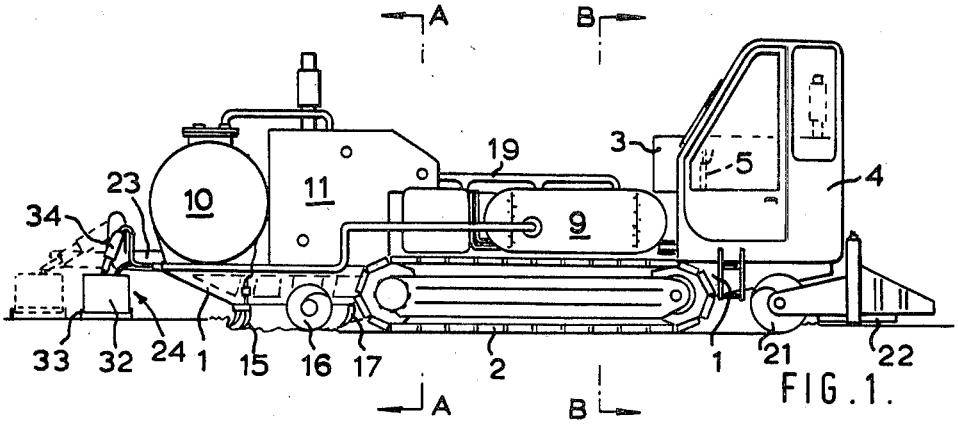
FIG. 1 shows, in a side view, the self-propelled apparatus for the regeneration of road, made of a bituminous mix, according to the present invention.

As one can see from the FIGS. 1 to 5, the self-propelled operating apparatus according to the invention is substantially composed of a sturdy frame 1 to which tracks 2 are mounted, provided with an engine 3 and a cab 4 with corresponding steering and guiding means 5. The tracks 2 act as drive means for the apparatus.

Furthermore, on the frame 1 there is provided: an electric generating unit 6, a fuel tank 7, a tank for cooling water 8, a tank for fluid for hydraulic transmissions and controls 9, a tank for bituminous binder 10, and a tank for filler 11.

At the axle base between the side members of frame, 1 a homogenizing and mixing device 12 is arranged which is of the counter-rotating blade type, the inclination angle of the blades being such that material entering at the front opening of the device 12 (FIG. 5) is conveyed toward the closed interior mixing chamber and then pushed toward the discharge back opening.

The closed bottom of the device 12 is placed at a small distance from the ground and includes, at its front, a chute 14 capable of receiving, forward toward the front opening of the device 12, material which has previously been heated, as will be better seen in the following part of the specification. This material is successively scarified by means of rippers 15, and removed towards the longitudinal axis of the apparatus by means of a collecting screw feeder 16, and scraped by means of a scraping blade 17.

During its passage through the device 12, the so treated bituminous mix is homogenized and mixed, and optionally completed by the addition of bitumen and/or filler, the first of these materials being sprayed from above by means of a plurality of nozzles 18 connected through tubing 19 with the tank 10, whereas the second material reaches the mix through a gravity feeding device composed of a batching screw feeder 20 provided inside the tank 11 at a projection of the tank itself, having at its bottom a plurality of holes coincident with the holes open through a portion of the upper wall of the device 12.

The so treated material, by means of the thrusting action of the counter-rotating blades 13 (FIG. 3 and 4) is discharged in a continuous way through the back opening of the device 12 (FIG. 5) and is distributed by means of a distributing screw feeder 21, connected to the frame 1, along the whole width of the excavation which has been opened by means of the rippers 15.

Successively, the material is laid out and compacted by means of a finishing plate 22, which too is connected to the frame 1.

The frame includes, at its front, an angular bracket 23 which is capable of supporting at least one set 24, provided for the heating of a layer of road carpet of a bituminous conglomerate. The width of the heated road carpet is equal to the length of the set (or sets) 24, whose action can be controlled both in depth and temperature.

Figure 6:
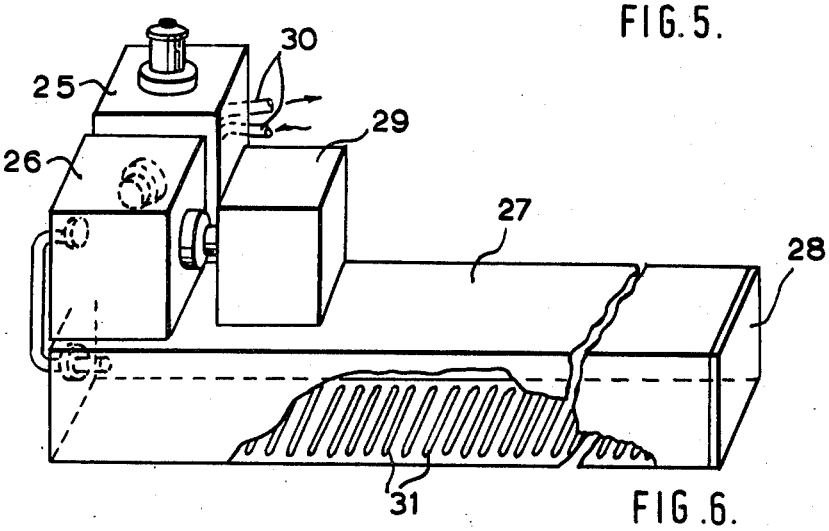
FIG. 6 shows schematically, a radio-frequency generating set, coupled with an illuminator device of the slotted wave-guide type according to the present invention.

As one can see from FIG. 6, each set 24 is substantially composed of a radio-frequency microwave oscillator 25 coupled through a power circulator 26 having three gates to a coaxial output, with an antenna including the type of a slotted wave-guide 27, closed at an opposed end by means of a short-circuit plug 28. The power circulator 26 is in turn connected with a resistive load 29.

The oscillator power generator 25 is fed, at the desired voltage, from the electric generating unit 6 (FIG. 2) and, in the preferred embodiment which is given forth as an indicative, but non-limitative example, the generator 25 is represented by a magnetron of the continuous-wave type, which generates power in the band of the millimeter wavelengths. For cooling the generator 25 a circuit 30 is provided which is of the water-circulation type, and which is fed by the tank 8.

The power circulator 26, of the type which is utilized in radio-links, has the function of preventing the reflected power, i.e. that portion of power due to the difference in propagation coefficient values between the air medium and the material composing the road carpet, as well as the one due to the reflection inside the antenna 27, from returning back towards the generator 25, thus creating inconveniences in operation, and causing instead its absorption by part of the power resistive load 29.

The antenna 27 is composed of a slotted wave-guide, in which each slot 31 represents an elemental dipole. The arrangement of the dipoles must be such that the radiation is uniformly distributed along the whole length of the wave-guide.

In an alternative embodiment, also an end termination (not represented) may be foreseen, since it may be interesting to re-utilize the power which cannot be radiated from the antenna 27.

Figure 2:
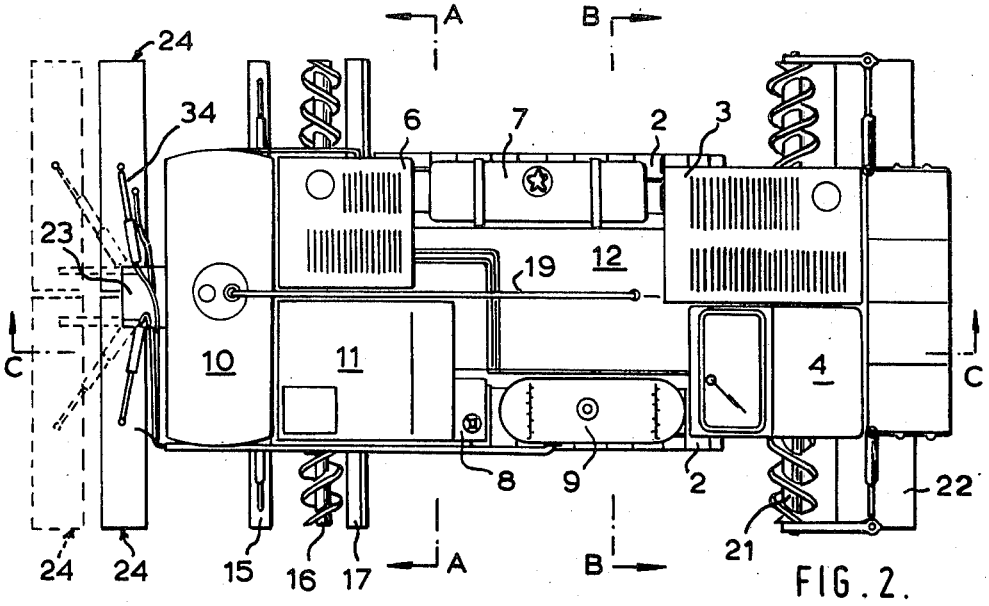
FIG. 2 shows the apparatus of FIG. 1 in a view from above.
Figure 3:
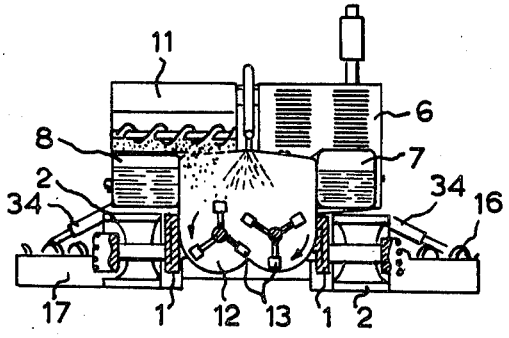
FIG. 3 shows the apparatus of FIG. 1 according to a cross-section corresponding to the line A—A of FIG. 1.
Figure 4:
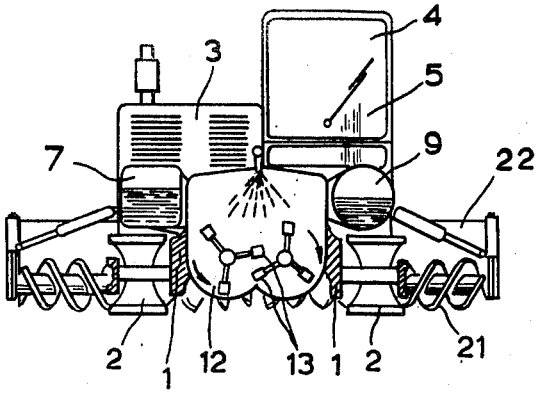
FIG. 4 shows the apparatus of FIG. 1 according to a cross-section corresponding to the line B—B of FIG. 1.
Figure 5:
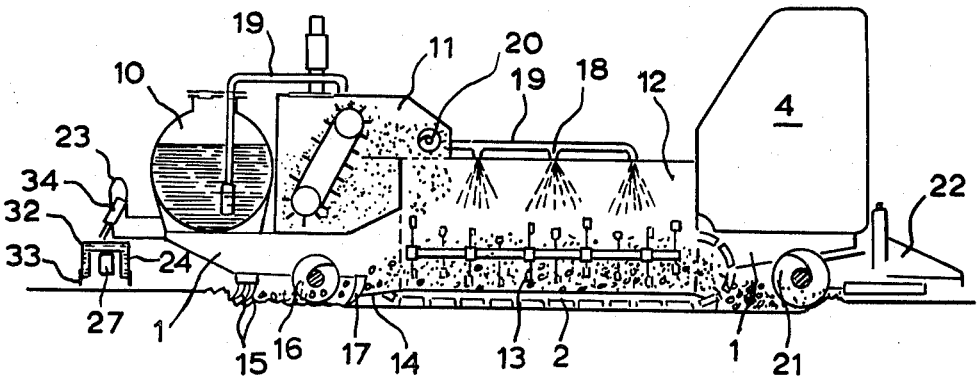
FIG. 5 shows the apparatus of FIG. 1 according to the longitudinal section which is indicated by the line C—C in FIG. 2.

The antenna 27, in order to facilitate the transfer movements of the operating apparatus according to the present invention or in order to reduce its range of action, may be provided of two stretches or portions which can be connected by flanges (FIG. 2).

Alternatively, each set 24 may be realized by two independent illuminators, symmetrically arranged along the same alignment.

For safety purposes, mainly for the protection of the operating personnel, the set or sets 24 are covered by a suitable shielding, achieved by means of a cap 32 (FIG. 5) composed of modular copper elements which covers the structure, the cap operating to prevent undesired radiation losses.

The cap 32 may be completed by flexible members 33, for instance composed of neoprene reinforced strips or the like, applied to extend below the periphery of the cap 32.

If one wants to accelerate the heating of the bituminous mix without increasing the temperature, one may foresee the use of a plurality of sets 24, arranged longitudinally one ahead of the other (FIG. 1 and 2), so that the paving area subjected to the radiation will be increased.

In any case, in the described embodiment the whole length each set is of about 4 to 4.5 m, which is an amount necessary and sufficient to intervene upon a whole highway lane, whereas its width is of the order of about 50 centimeters. The advantage of better compactness of the operating apparatus according to the invention, is achievable through the use of the microwave energy source instead of conventional sources, such as for instance infrared-ray heating batteries, which have a length of many meters and are difficult in maneuvering, particularly in road route stretches which are situated on a curve.

In the described embodiment, an electric generating unit 6 is foreseen, which is connected with the bracket 23 and is fed by the fluid contained within the tank 9.

The feeding speed of the self-propelled operating apparatus thus shown and described is foreseen to reach up to 4 m per minute. Obviously, all the elements composing the apparatus are so dimensioned that the whole work will be effected without any discontinuity. The amount of bituminous mix which is heated, ripped, collected, raised and introduced during a certain time period into the homogenizing and mixing device 12, is determined as a function of the desired feed velocity, and must be such that during the same period of time the same amount of bituminous mix, with optional additions of a bituminous binder and filler, will be able to be treated by the device 12 and then discharged, distributed and compacted, thus achieving the total regeneration of the road carpet.

It is to be pointed out that, by means of the employment of heating sets composed of a radio-frequency microwave generator coupled with an antenna of the slotted wave-guide type, it is feasible to control the depth of the heated layer, so that, without modifying the temperature and the feed speed of the apparatus, such thickness will be larger than the thickness of the layer which one wants effectively to scarify in order to subject it to the mixing and homogenizing treatment.

The heating of the layer underlying the one that must be scarified and treated appears to be advantageous, since a total or partial heating of the materials composing the deeper layer allows the elimination of possible cracks present in the layer and/or their compaction, this being a result which cannot be achieved by the use of conventional energy sources, whose action is limited to a few centimeter thickness, generally from 3 to 5 cm.

Furthermore, the treated upper layer will not simply be adhered to the surface of the underlying layer, but finally a faultless connection will take place between the upper layer and the underlying layer, without, nevertheless, modifying in a remarkable way the granulometric different state and distribution of the lithoid inert materials.

According to a further characteristic of the operating apparatus according to the present invention, it is foreseen that the scraping blade 17 and the chute 14 be of the type which can be raised, so that the material scarified by means of the rippers 15 and removed by the collecting and distributing feed screws, 16 and 21, respectively, may be directly compacted by the finishing device 22. In this way, the material can be prevented from passing and mixing device 12, whenever, according to the sole judgment of the operator, such homogenizing and mixing treatment, with or without the addition of a filler or a binder agent, is deemed unnecessary.

Lastly, it is to be pointed out that, as a function of the arrangement of the bottom of the device 12, being at a small distance from ground, the materials resulting from the demolition of the old paving to be re-made will enter the device directly without any need of further mechanical lifting means, but only through the help of the chute 14, with remarkable advantages connected with the speed and the work's general economy.

I claim:

1. A self-propelled operating apparatus for resurfacing roadway pavement, one lane at a time, which pavement is made of a bituminous mix, comprising:

a single frame;

drive means mounted on said frame for propelling said frame on a lane of a roadway to be resurfaced in an operating direction;

steering means connected to said frame and said drive means for steering said frame as it is propelled on a roadway in said operating direction;

an electric generating unit mounted on said frame;

wave-guide antenna means connected to said frame at a forward end thereof extending transversely to said operating direction and of a length to extend substantially across the lane of roadway to be resurfaced, said wave-guide antenna means comprising at least one wave-guide having an open space and a slotted bottom surface adapted to face the roadway with a plurality of slots extending in said operating direction and spaced on said wave-guide transversely to said operating direction, said wave-guide having a short circuit plug plate closing one end thereof and an opposite end;

the radial-frequency generator mounted on said wave-guide adjacent said opposite end thereof and connected to said electric generating unit for generating microwaves;

a tri-gate power circulator mounted on said wave-guide adjacent said opposite end thereof and connected to said radial-frequency generator and said wave-guide at said opposite end thereof for distributing microwave energy to the interior of said wave-guide;

a resistive load mounted on said wave-guide adjacent said opposite end thereof and connected to said tri-gate power circulator for absorbing at least some micro-wave energy reflected inside said wave-guide back to said circulator;

a coolant storage tank mounted on said frame connected to said radial-frequency generator for supplying coolant thereto and cooling said radial-frequency generator;

ripping means connected to said frame and extending downwardly for engaging a roadway to be resurfaced, said ripping means positioned behind said wave-guide antenna means in said operating direction and sufficiently close to said wave-guide antenna means for ripping up roadway to be resurfaced while the roadway to be resurfaced is still hot after having been heated by micro-wave energy leaving said wave-guide antenna means;

first conveyor means connected to said frame and extending downwardly thereof toward a roadway surface and behind said ripping means in said operating direction for collecting roadway surface ripped by said ripping means and moving it toward a central axis of said frame in said operating direction;

movable shaving blade and chute means movably mounted to said frame and extending below said frame behind said first conveyor means in said operating direction for directing material conveyed by said first conveyor means away from a roadway from which the material came, said shaving blade and chute means being movable away from a roadway to permit material conveyed by said first conveyor means to remain on the roadway;

mixing means mounted to said frame adjacent the central axis thereof including a mixing chamber having a forwardly facing inlet in said operating direction positioned behind said shaving blade and chute means in said operating direction, and a rearwardly facing outlet behind said inlet in said operating direction, said chamber having a closed bottom between said inlet and outlet, said mixing means including a pair of counter-rotating blade mixers for mixing material supplied into said inlet from said shaving blade and chute means;

a bituminous binder tank mounted on said frame;

tubing connected between said tank and the top of said mixing chamber having a plurality of injection nozzles for directing bituminous binder into said chamber;

a filler tank mounted on said frame having a peforated bottom portion positioned over a forward portion of said mixing chamber in said operating direction;

dosing means movably mounted to said frame in said filler tank for dosing filler material to said mixing chamber;

second conveyor means mounted to said frame and positioned behind said mixing chamber outlet in said operating direction for distributing material from said mixing chamber outwardly from said central axis across a lane of a roadway to be resurfaced; and finishing plate means mounted to said frame and extending below said frame behind said second conveyor means in said operating direction for compacting material onto a roadway to be surfaced, which material is provided from one of said mixing chamber outlet and an area of roadway to be surfaced below said mixing chamber.

2. An apparatus according to claim 1, wherein said radial-frequency generator comprises a magnetron forming a microwave radio-frequency oscillator for generating wave power in the millimeter wave length.

3. An apparatus according to claim 1, including a shielding cap made of modular copper elements positioned over and covering tops and sides of said wave guide antenna means, a downwardly extending flexible member connected to a lower forward and rear periphery of said cap in said operating direction.

4. An apparatus according to claim 2, wherein said mixing chamber is mounted on said frame so that a bottom thereof is positioned at a small distance fron the roadway to be resurfaced when said apparatus is used to resurface the roadway, said shaving blade and chute means comprising a shaving blade positioned between said first conveyor means and said mixing chamber inlet and a chute extending from said mixing blade up toward said mixing chamber inlet.

5. An apparatus according to claim 1, including lifting means connected between said wave guide antenna means and said frame for changing a height of said wave guide with respect to a roadway surface.

* * * * *